US008474386B2

(12) United States Patent
DelloRusso, Jr.

(10) Patent No.: US 8,474,386 B2
(45) Date of Patent: Jul. 2, 2013

(54) FIRE RESISTANT CONTAINMENT SYSTEM HAVING A LIGHT WEIGHT PORTABLE REMOVABLE ENCLOSURE

(76) Inventor: Anthony J. DelloRusso, Jr., Bernardsville, NJ (US)

( * ) Notice: Subject to any disclaimer, the term of this patent is extended or adjusted under 35 U.S.C. 154(b) by 0 days.

(21) Appl. No.: 13/385,448

(22) Filed: Feb. 21, 2012

(65) Prior Publication Data

US 2012/0180707 A1 Jul. 19, 2012

Related U.S. Application Data

(63) Continuation-in-part of application No. 12/589,870, filed on Oct. 28, 2009, now Pat. No. 8,327,778.

(51) Int. Cl.
*E04B 2/02* (2006.01)
*E06B 5/12* (2006.01)

(52) U.S. Cl.
USPC ..... 109/80; 109/26; 109/76; 109/84

(58) Field of Classification Search
USPC ..... 109/26–28, 58, 59 R, 64, 66, 74, 109/76, 77, 80, 83, 84
See application file for complete search history.

(56) References Cited

U.S. PATENT DOCUMENTS

| | | | | | |
|---|---|---|---|---|---|
| 2,613,623 | A | | 10/1952 | Behrens | 109/59 R |
| 3,408,966 | A | | 11/1968 | Gartner | 109/74 |
| 3,709,169 | A | * | 1/1973 | Gauger et al. | 109/29 |
| 3,762,787 | A | * | 10/1973 | Grubb | 109/80 |
| 3,855,741 | A | | 12/1974 | Semon | 52/19 |
| 3,855,949 | A | * | 12/1974 | Foster et al. | 109/23 |
| 4,048,926 | A | | 9/1977 | Brush, Jr. et al. | 109/65 |
| 4,263,365 | A | | 4/1981 | Burgess et al. | 428/312.4 |
| 4,272,137 | A | | 6/1981 | Rothhaas | 312/409 |
| 4,307,543 | A | | 12/1981 | Schulthess | 49/501 |
| 4,574,454 | A | | 3/1986 | Dyson | 29/434 |
| 4,593,627 | A | * | 6/1986 | Lankard et al. | 109/83 |
| 4,721,227 | A | | 1/1988 | Hughes et al. | 220/560.01 |
| 4,735,155 | A | | 4/1988 | Johnson | 109/24 |
| 4,741,276 | A | | 5/1988 | Pollock | 109/25 |
| 4,893,397 | A | * | 1/1990 | Hughes | 109/65 |
| 5,069,358 | A | * | 12/1991 | Avery, Jr. | 109/84 |
| 5,152,231 | A | | 10/1992 | Preston et al. | 109/65 |
| 5,970,889 | A | | 10/1999 | Shaffer et al. | 109/65 |
| 6,158,833 | A | * | 12/2000 | Engler | 109/84 |

(Continued)

FOREIGN PATENT DOCUMENTS

JP 8270323 10/1996

*Primary Examiner* — Christopher Boswell
(74) *Attorney, Agent, or Firm* — Ernest D. Buff; Ernest D. Buff & Assoc. LLC; Dave Narasimhan

(57) ABSTRACT

A lightweight portable fire resistant containment system comprises an outer shell and a lid. Free surfaces of the outer shell and lid are covered to prevent ingress of hot gas. The outer shell may have an inner shell forming an insulating air gap. Outer shell, inner shell and lid are fabricated from inorganically bonded high temperature resisting ceramic fibers. The outer surface of the inner shell has a metallic infrared reflecting wrap. An encased phase change material containment absorbs heat by melting or decomposition. A wooden or plastic lightweight portable box enclosure with cover is placed within the interior surface of the containment for storage of valuable documents, photographs and magnetic media. A jump drive within the portable box preferably houses the magnetic media. When the fire resistant containment system is exposed to 1550° F. for 30 minutes the interior of lightweight portable box enclosure remains below 125° F.

15 Claims, 5 Drawing Sheets

U.S. PATENT DOCUMENTS

| | | | | |
|---|---|---|---|---|
| 6,170,481 | B1 | 1/2001 | Lyons et al. | 126/512 |
| 6,736,473 | B2 * | 5/2004 | Cleveland et al. | 109/80 |
| 6,752,092 | B2 | 6/2004 | Beattie et al. | 109/75 |
| 6,841,209 | B2 | 1/2005 | Legare | 428/34.4 |
| 7,459,190 | B2 | 12/2008 | Legare | 428/43.4 |
| 8,327,778 | B2 * | 12/2012 | Dellorusso, Jr. | 109/80 |

* cited by examiner

FIRE RESISTANT CONTAINMENT SYSTEM HAVING A LIGHT WEIGHT PORTABLE REMOVABLE ENCLOSURE

This application is continuation in part of application Ser. No. 12/589,870, filed Oct. 28, 2009, now U.S. Pat. No. 8,327,778 entitled "LIGHT WEIGHT PORTABLE FIRE RESISTANT CONTAINMENT SYSTEM", the subject matter of which is hereby incorporated by reference in its entirety.

BACKGROUND OF THE INVENTION

1. Field of the Invention

The present invention relates to fire resistant containment systems; and, more particularly, to fire resistant containment system comprising a lightweight portable box enclosure that can be easily moved from place to place for preserving memory objects such as photographs, documents and the like in case of a fire event.

2. Description of the Prior Art

Many patents address issues related to fire resistant containment systems. The patents and patent publications that disclose fireproof containment are discussed below. These containment systems are generally heavy and cannot be easily transported from place to place. Individual memory objects have to be first removed from the heavy containment system. Also the fireproof containment systems need to meet Underwriter Laboratories test specification UL72, section 5 which details a fire endurance test in three classes, class 350, class 150 and class 125. A class 350 containment system limits the temperature of contents of the system to 350° F. when exposed to a fire of 1550° F. for 30 minutes. There is no humidity requirement for these containment systems since 350° F. is well above the boiling point of water which is 212° F. any water that is present in the containment will be evaporated and flood the interior of the system. A class 150 containment system limits the contents of the system to a temperature of 150° F. with a humidity of no more than 85% when exposed to a fire of 1550° F. for 30 minutes. A class 125 containment system limits the contents of the system to a temperature of 125° F. with a humidity of no more than 80% when exposed to a fire of 1550° F. for 30 minutes. A class 125 containment system protects films, photographs, magnetic media and provides the most stringent requirement for a fireproof box. Most of the prior art fireproof systems of the prior art do not meet the class 125 requirements.

U.S. Pat. No. 2,613,623 to Preston et al. discloses an insulated filing cabinet construction. The file cabinet is made from steel casing that forms a plurality of rectangular boxes. Each wall of the casing contains insulating material. Inherently, the insulated filing cabinet disclosed by the '623 patent is a heavy weight device, as shown by the requirement of casting wheels at the bottom. The insulating material is not indicated to withstand high temperature exposure. This heavy weight cabinet does not contain a lightweight portable enclosure.

U.S. Pat. No. 3,408,966 to Gartner discloses a fireproof container. This fireproof container has an inner container surrounded by an outer container. A heat protection liner made from fibrous material having high temperature insulation properties is provided between the outer frame and the inner container. A jamb having an irregular undersurface portion with fibrous material is positioned in mating relationship with the jamb, providing a torturous heat flow closure path. The fireproof container has an outer shell of cold rolled steel, an inner container of molded plastic, and two layers of fibrous high temperature resistant fibers, followed by heat insulative fibers. Such a fireproof container, as disclosed by the '966 patent, is a heavy object. It is not made entirely from high temperature resisting fibers that have a high level of porosity, providing insulation properties and does not have a removable lightweight portable enclosure.

U.S. Pat. No. 3,855,741 to Semon discloses a closure for a fire resistant structure. This container is protective against a high temperature of restricted duration. The cast container with plaster of Paris is destroyed by high temperature exposure, while the magnesium sulfate hydrate degrades in steps, leaving behind a fire resistant composition. This fire resistant structure has a facing of low melting glass cloth with epoxy bond. Gypsum partially decomposes only between 212° F. and 312° F. and heat is absorbed during the decomposition reaction and this temperature is too high to keep the interior of the fire resistant structure at or below 125° F. The magnesium sulfate hydrate component decomposes at a lower temperature, but the tests were conducted at much higher temperatures of 2522° F. (1400° C.) and 1166° F. (630° C.), and the fire resistant structure is indicated to survive the high temperature exposure. But there is no measurement of temperature within the fire resistant structure and the tests performed were not according to Underwriters Laboratories specification UL72. Such a fire resistant structure is heavy due to gypsum content. It is not made from fibrous material and does not have a removable portable enclosure.

U.S. Pat. No. 3,709,169 to Gauger et al. discloses a fireproof container. This container is designed to protect valuable items such as papers from exposure to fire or intense heat. The container comprises an outer frame, an inner container, and a closure means or a lid. Between the outer frame and inner container, and within the lid, there are heat protection means, each comprising an outer portion of a heat resistant material such as ceramic fiber and an inner portion of an absorbent material such as glass paper which is soaked in water and encased in a water-impermeable jacket made of, for example, polyethylene, which ruptures upon exposure to elevated temperatures. Typically, vents permit steam which is generated in the presence of intense heat in the inner portions of the heat protection means to pass into the interior of the container to further slow any rise in temperature therein by absorbing heat, and the vents also permit steam to slowly pass out of the container through the channel defined between the closure means and the container itself, thereby inhibiting the inward flow of heat through this channel. In a preferred embodiment, a water-soaked, elongated, fibrous, absorbent material, encased in an elongated water-impermeable jacket, is disposed between the outer frame and inner container at a location subject to high heat transfer rates, such as along the jamb between the outer frame and the inner container. During fire exposure the water contained in the absorbent material or fibrous absorbent material boils at 212° F. releasing a large amount of steam. In spite of the vents provided some amount of steam would be directed into the contained area soaking all of the contents with water. Moreover, 212° F. is much greater than the target requirement of 125° F. or 150° F.; and this water boiling temperature is sufficient to damage magnetic medium and photographs. The fireproof container is not indicated to have a removable portable enclosure.

U.S. Pat. No. 4,048,926 to Brush, Jr. et al. discloses a safe. The safe has a non-metallic outer shell, an inner shell with molded insulation material therebetween. The molded material is indicated to have a substantial amount of chemically bonded water similar to foamed Portland cement. During fire exposure the chemically bonded water dissociates losing the properties of the Portland cement releasing a large amount of steam and this decomposition occurs at a temperature much greater than 125° F. The safe is not made from ceramic fibrous material bonded with water free inorganic bond. The safe is not indicated to have a removable portable enclosure.

U.S. Pat. No. 4,263,365 to Burgess et al. discloses a fire-resistant safe and panel. This safe has a heat absorbing body made from a mixture of water, Portland cement, cellulose fibers, and a foaming agent, with or without other ingredients such as water glass and sodium sulfate. Polypropylene fibers may be used in place of part or all of the cellulose fibers. The safe has a plastic outer shell and an inner shell made from plastic or steel. The space between the inner and outer shell is filled with foamed cement composition that has recycled cellulose fibers. Sodium silicate may be added to the cement mixture. The composition resists fire by breaking down water of hydration releasing a large amount of steam as the Portland cement composite crumbles by heat at a temperature much greater than 125° F. Cement is heavy and consequently the safe is not portable. The safe does not use lightweight fire resistant ceramic fibers bonded with water free inorganic bond. The safe is not indicated to have a removable portable enclosure.

U.S. Pat. No. 4,272,137 to Rothhaas discloses a fire resistant cabinet with a protective void in gypsum filling. A heat resistant cabinet has a gypsum filling provided in the interspace between the outer casing and the inner surface. This filing cabinet has a metal sheet outer surface with gypsum filling. The gypsum filling has a hollow space provided for subsequent use as an air gap space or filling by plastic foam. Gypsum decomposes when exposed to heat by loss of water of hydration, releasing a large amount of steam essentially crumbling the gypsum layer. Gypsum partially decomposes between 212° F. and 312° F. and heat is absorbed during the decomposition reaction. Moreover a temperature between 212° F. and 312° F. is too high to keep the interior of the fire resistant structure at or below 125° F. The gypsum sheet is indicated to crack especially around the free space area. This is a heavy cabinet and not a portable device. The safe does not use fire resistant ceramic fibers bonded with water free inorganic bond. The fire resistant cabinet is not indicated to have a removable portable enclosure.

U.S. Pat. No. 4,307,543 to Schulthess discloses a door. This door is primarily intended for applications that require a fire resistant door. The door has a metal frame with a foamable strip present in the rebate of the door. The strip foams when heated by a fire, sealing the door. The '543 disclosure does not provide a flameproof box for containment of photographs and documents. The door is not indicated to have a removable portable enclosure.

U.S. Pat. No. 4,574,454 to Dyson discloses a method of constructing fire resistant enclosures. In this method a body of a cabinet for storing temperature-sensitive articles such as magnetic discs and tapes is built by a process which involves the successive steps of fabricating an internal skin; (ii) attaching "phase-change" material to the skin; (iii) applying insulative polyurethane foam in-situ to the structure of step (ii); (iv) casting concrete or the like water-bearing material around the structure of step (iii); and (v) completing the outer finishing skin. The door for the cabinet can be built by a similar sequence in which "phase-change" material, insulative form and water-bearing layers are applied successively to a pan forming the internal face of the door. The fire resistant enclosure is heavy due to the use of cement and does not use lightweight ceramic fibers bonded with a water free inorganic bond. The fire resistant enclosure is not indicated to have a removable portable enclosure.

U.S. Pat. No. 4,721,227 to Hughes et al. discloses a fire-resistant container. This fire-resistant container is said to protect magnetic media such as floppy discs, and comprises a base and a cover. The fire resistant metal container has outer casing and inner container and the space between filled with microporous compacted material made from finely divided silica, opacifiers and aluminosilicate reinforcement fibers. The inner container is filled with wax having a melting point of 122° F. (50° C.). The fire-resistant container is not a lightweight fire resistant container and it is not made from fireproof ceramic fibers bonded with water free inorganic bond. The fire resistant cabinet is not indicated to have a removable portable enclosure.

U.S. Pat. No. 4,735,155 to Johnson discloses a fire resistant enclosure. The casing and door for this enclosure is made from resinous material such as epoxy polyimide or polyvinyl chloride that chars readily. The resin may be reinforced with mineral fiber in the form of glass wool, and protected with heat reflecting aluminum sheet. The enclosure is a multi-component heavy device. It does not rely on lightweight fire resistance of a ceramic fiber insulation bonded with water free inorganic bond and does not rely on the porosity of the ceramic fiber matrix to resist heat flow. The fire resistant enclosure does not have a removable portable enclosure.

U.S. Pat. No. 4,741,276 to Pollock discloses a fire resistant cabinet. This fire resistant cabinet is for maintaining its contents below a predetermined temperature and comprises an inner container partly of double-walled construction, a material located within the walls of the inner container and which undergoes a phase change requiring latent heat below the predetermined temperature. The outer casing is provided surrounding and spaced apart from the inner container. A thermal insulation layer is provided between the outer casing and the inner container comprising a plurality of spaced apart, low thermal emissivity, heat shields each being parallel to the adjacent wall of the outer casing. At least six bridge members connect the inner container and the outer casing, each bridge member being of zig-zag shape and defining a plurality of slots extending generally parallel to the crests of the zig-zag, the bridge members supporting the inner container relative to the outer casing even if the cabinet is subjected to an impact. The fire resistant cabinet disclosed by the '276 patent uses hydrated sodium meta silicate which melts and disassociates at 48° C. or 118° F. The cabinet has metallic zig zag heat shields and does not have lightweight fibrous ceramic insulation that is inorganically bonded. The microporous insulation of silica aerogel is not a fibrous insulation; but is instead a dust without mechanical integrity sufficient to support the container. The fire resistant cabinet does not have a removable portable enclosure.

U.S. Pat. No. 5,152,231 to Preston et al. discloses a fire-resistant safe. This fire resistant safe is made from resin sheets that form the interior enclosure and exterior enclosure with insulation provided there between. As the resin catches fire, it produces vertical channels for the passage of air, promoting vigorous combustion. Vertical air flow is prevented (i) by use of corner jambs that are made thin, thereby producing a narrow air flow, restricted pathway, or (ii) by use of compressively loaded resin sheets. The fire resistant safe does not use insulation of lightweight ceramic fibers bonded with a water free inorganic bond. The fire resistant safe does not have a removable portable enclosure.

U.S. Pat. No. 5,970,889 to Shaffer et al. discloses a steel shell safe with a snap-in resin liner. This safe has an outer steel shell with a resin liner inserted there within. An insulation material is provided between the steel shell and the resin liner. The steel shell safe with snap in liner is heavy and is not a lightweight product. It does not use insulation of lightweight fire resistant ceramic fibers bonded with a water free inorganic bond. The steel shell safe does not have a removable portable enclosure.

U.S. Pat. No. 6,170,481 to Lyons et al. discloses an open-ended molded fireplace box and method. Disclosed therein is a molded ceramic fiber insert that is directly cast into a heavy steel component, which is designed to be inserted into a fireplace. Such a fireplace insert is not a portable lightweight system that uses porously bonded fire resistant ceramic fibers with a water free inorganic bond; it is not designed to protect photographs and documents. The fire place box does not have a removable portable enclosure.

U.S. Pat. Nos. 6,841,209 and 7,459,190 to Legare disclose fire protection containers incorporating novel low free-water insulation materials. The fire protection containers house water-bearing silicate materials. This is achieved by modifying the basic method of essentially reacting water glass with calcium chloride to bind the free water into solid form without adversely affecting the basic chemical and physical structure of the original product. The material is then dried by using a physical wicking agent, such as a cellulose sponge, adding an anhydrous salt to the material to form a crystalline hydrate, or adding calcium oxide or calcium hydroxide to the material to form a microstructure that physically retains the water. The material is then incorporated into a fire protection container in which the material forms the outermost wall of the container, a light-weight porous material such as urethane forms an intermediate layer, and a phase change material with a melting point of around 70° F. to 125° F. forms the innermost wall. The modified water bearing silicate material, when solidified, is heavy and does not use lightweight fire resistant ceramic fibers bonded with a water free inorganic bond. The fire protection containers do not have a removable portable enclosure.

U.S. Pat. No. 6,752,092 to Beattie et al. discloses a fire and water-resistant container. The bottom and top shells are made from metal or resin and the space there between is filled with a fire proof insulator composed of hydrated Portland cement. The container is therefore heavy due to the cement insulation. The hydrated Portland cement will disintegrate due to loss of water of hydration when exposed to fire. The shell, hinge and gasket may also be destroyed by fire as indicated in the '092 patent. The fire and water-resistant container does not use lightweight fire resistant ceramic fibers bonded with a water free inorganic bond. The fire and water-resistant container does not have a removable portable enclosure.

Foreign Patent Application No. JP 08270323 to Hineno discloses a fireproof safe. A box has an outer case that contains an inner case. The space between the two cases is filled with burnt ash of activated carbon, which is a very porous carbon material. The burnt activated carbon ash is no longer a fiber and therefore, it is not a lightweight fire resistant ceramic fiber bonded with a water free inorganic bond. The type of material used for the outer case and the inner case is not indicated. The fireproof safe does not have a removable portable enclosure.

There remains a need in the art for a lightweight fire resistant containment system that has a lightweight portable box enclosure which is easy to carry. Also needed in the art is a lightweight fire resistant containment system that saves valuable documents, photographs and magnetic and electronic media in a in an unaffected condition even when exposed to a fire temperature of 1550° F. for up to 30 minutes. Further needed in the art is a lightweight fire resistant containment system wherein the contents of a lightweight portable box enclosure are not exposed to temperatures greater than 125° F. when the containment system is subjected to a fire temperature of 1550° F. for up to 30 minutes

SUMMARY OF THE INVENTION

The present invention discloses a lightweight fire resistant containment system comprising: (i) a outer shell with a outer surface and an inner surface; (ii) said outer shell, being made from ceramic fibers bonded with inorganic based bonds; (iii) said outer surface of said outer shell having a stainless steel or polymeric sheath preventing entry of hot gases from a fire flame into the porous bonded ceramic fibers of said outer shell; (iv) said outer shell optionally having an inner shell having an outer surface and an inner surface made from inorganically bonded ceramic fibers and said outer surface of the inner shell fitting within the inner surface of the outer shell with an air gap there between; (v) said optional inner shell outer surface having a metallic covering reflecting infrared heat emitted by the inner surface of the outer shell; (vi) a lid being made from inorganically bonded ceramic fibers covering the top outer surface of the outer shell, forming a closed enclosure; (vii) said inner surface of the outer shell or the inner surface of the optional inner shell having an encased phase change material containment, absorbing heat by latent heat of fusion during melting and preventing temperature rise of encased phase change material containment beyond the melting point until all of phase change material contained is completely molten; (viii) a lightweight portable box enclosure made from a wooden box or polymeric box with a closure for containing valuable documents, photographs and magnetic or electronic media and documents intimately contacting the inner surface of encased phase change material containment; ix) optionally, said encased phase change material containment being made from filling a porous bonded ceramic fiber mass with molten phase change material having an open bottom hole for discharging molten PCM into the air gap between the outer shell and inner shell, thereby creating a porous insulating body providing further insulation that prevents further heating of the storage compartment's valuable contents.

The lightweight portable box enclosure of a wooden or polymeric box within the phase change material provides additional thermal protection to the valuable documents, photographs and magnetic or electronic media and maintains the temperature within the box below 125° F. in a kiln that is brought to a temperature of 1550° F. for 30 minutes, according to Underwriter Laboratories specification UL72 during a fire exposure test (UL72 Section 5). The lightweight portable box enclosure of a wooden or polymeric box can be withdrawn from the fire resistant containment system and easily moved from place to place for viewing and use. The outer and optional inner shell may have a wall thickness in the range of 12 mm to 25 mm. The air gap may have a dimension in the range of 0.1 mm to 6 mm. The optional inner shell may have a wall thickness in the range of 8 mm to 20 mm. The encased containment of phase change material may have a thickness of 15 to 25 mm.

The outer shell of the lightweight fire resistant containment system is entirely fabricated from ceramic fibers that may be woven, non-woven or needled. Fibers arranged in this manner have a small air space there between and are quite insulating since they trap air. Inasmuch as the ceramic fibers easily withstand a temperature of 1550° F., a typical maximum temperature attained in house fires, these fibers in the outer shell do not melt or degrade. The ceramic fibers may be mineral wool, glass fibers including S glass, E glass or common fiberglass. The fibers are locked in place by an inorganic binder such as sodium silicate, which upon interaction with ambient carbon dioxide results in colloidal silica that bonds the ceramic fibers. Thus the formed outer shape is lightweight, rigid and holds the shape of a storage container, which may be made from stainless steel of a polymer material preventing the entry of hot gases into the lightweight porous fiber composite outer shell. The outer lightweight porous fiber composite outer shell may instead be painted with a silicone or other suitable resin that blocks the pores of the outer surface of the outer shell and is heat resistant. The lid for the storage compartment is also prepared in a similar manner.

The optional inner shell is fabricated in a manner similar to the outer shell and also has insulation properties. The optional inner shell is offset from the outer shell leaving an air gap that provides insulation. The overall weight of the lightweight fire resistant containment system is due to the lightness of the lid, outer shell, inner shell and the air gap there between. As the outer shell is subjected to fire from a house flame, the outer surface of the outer shell reaches high temperature quickly due to its low mass. However, the heat from the outer surface of the outer shell is only conducted through the wall of the outer shell due to the insulation properties of the bonded ceramic fibers together with air gaps present there between. After some time of fire exposure, the outer surface of the inner shell begins to receive heat from radiation from the inner surface of the outer shell.

The optional inner shell outer surface has a metallic infrared reflective covering that effectively reflects the radiation emitted by the inner surface of the outer shell. Thus the radiation emitted from the hot inner surface of the outer shell only slowly imparts heat to the inner shell, heating its outer surface. Due to the insulation properties of the inner shell, it takes a long time for the interior surface of the inner shell to heat to high temperatures that are sufficient to damage the photographs of documents contained within the lightweight portable fire resistant containment system. The overall heat content, which is controlled by the mass of the outer and the optional inner shells collectively, is small due to the low density of inorganically bonded ceramic fibers.

The encased phase change material may be held within the inner surface of the outer shell or the inner surface of the inner shell if present of the storage box in a suitable container such as a steel of polymeric flask that contains the powder of the phase change material. Alternatively a porous fibrous body made rigid by inorganic bond may be filled with molten phase change material. The encased porous ceramic containment may have a bottom hole that is plugged during infiltration of the phase change material. The encased porous ceramic containment is cooled to freeze the phase change material within the porous ceramic body. Both these arrangements will absorb incoming heat effectively holding the temperature at the melting temperature of the phase change material until all the phase change material provided is completely molten. This depends on the amount of phase change material provided and its latent heat absorption capability. The interior surface of the encased containment of phase change material contacts the wooden or polymeric box with a cover that contains valuable photographs, magnetic or electronic media or photographs for safe keeping during a fire exposure event. This strategy allows the lightweight portable box containing valuable documents, photographs and magnetic or electronic media placed in the fire resistant containment system to be removed for examination and display, and is completely protected in a typical house fire situation for a time period of about 30 minutes when exposed to a temperature of 1550° F.

Several compositions of phase change material include hydrated inorganic salts. Each of these phase change materials has a unique melting point together with known latent heat of fusion, which is the heat that is effectively absorbed during phase change. The preferred phase change material is sodium thiosulfate pentahydrate ($Na_2S_2O_3.5H_2O$) which has a melting or decomposition point of 118° F. and a latent heat of fusion of 210 kilojoules per kilogram. It has a density of 1.729 grams per centimeter cubed. Therefore, on a volume basis, sodium thiosulfate pentahydrate has a latent heat capacity of 210×1.729 or 363 kilojoules per decimeter cube. Since the melting point of sodium thiosulfate pentahydrate is 118° F., the interface between the PCM material and the wooden or plastic box is maintained at 118° F. until all of the phase change material has melted, the interior of the wooden or plastic box that contains the valuable documents, photographs or magnetic or electronic media stays well below the required 125° F. target of the Underwriters Laboratory specification UL72. On heating sodium thiosulfate pentahydrate decomposes at 118° F. forming a liquid phase and a solid phase. The liquid phase does not evaporate since all the heat absorption occurred at 118° F. and the interior of the box is well below the 125° F. The boiling of the water-containing phase requires heating to the boiling point of water, which is 212° F. Thus the inside of the box containing valuable materials is not exposed to steam and maintains a low value of humidity.

Briefly stated, the invention involves a storage box having an outer shell made from fibrous ceramic that is boned by inorganic adhesive, which does not smoke. Optionally a similar inner shell may be used with an air gap between the outer shell and the inner shell. A tight fitting lid closes the storage box. The outer shell, inner shell and lid are all made from bonded ceramic fibers that provide low mass thereby reducing heat retention, and enhancing insulating effect due to porosity. Thus the outer surface of the outer shell heats first, conducting heat slowly through the thickness of the outer shell, heating the optional inner surface of the outer shell. The heat has to be emitted by infrared radiation through the air gap, if present, between the outer shell and the inner shell, heating the outer surface of the inner shell. A reflective metal foil may cover the outer surface of the inner shell reducing the amount of radiated emission from the inner surface of the outer shell. Any heat that is absorbed is conducted through the thickness of the optional inner shell to the interior of the inner shell, which contains encased phase change material that absorbs heat at its melting point, holding the temperature of the phase change material at the melting temperature. A wooden or plastic box with a cover is inserted so that it contacts the phase change material interior surface. The lightweight containment box, made from wood or plastic, contains the valuable documents, photographs and magnetic or electronic media. The entire wood or plastic box can be pulled out of the storage box and used to carry around and display the contents with ease. Due to the insulating properties of the wood or plastic body of the box, the temperature in the interior of the storage box does not exceed 125° F. even after exposure to flame for 30 minutes in a test performed according to Underwriter Laboratories specification UL72.

Significant advantages are realized by practice of the present invention. The key features of the lightweight portable fire resistant containment system include, in combination, the features set forth below:

1) a portable fire resistant containment box having an outer shell, optional inner shell spaced from the outer shell by an air gap and a lid creating an enclosed space;
2) said outer shell and optional inner shell and lid being entirely fabricated from fire resistant ceramic fibers including mineral wool fibers, glass fibers and the like bonded to each other by an inorganic bond, forming a porous insulating yet mechanically strong structure;

3) said inorganic bond created by sodium silicate being exposed to carbon dioxide to create a colloidal silica inorganic bond, hydrated to create a magnesium sulfate hydrate inorganic bond or a metal organic compound heated to create a metal oxide inorganic bond;

4) said outer shell covered with a stainless steel or polymeric sheath or painted with temperature resisting resin to prevent entry of hot gases from the flame into the porosities of a bonded ceramic fiber outer shell;

5) the outer surface of said optional inner shell covered with an infrared reflecting metallic sheet to reduce the amount of heat radiation received from the inner surface of said outer shell thereby reducing the heating rate of the inner shell;

6) said interior surface of said outer shell or optional inner shell having an encapsulated phase change composition containment comprising a metallic or polymeric containment filled with phase change material powder having a melting temperature less than 125° F.;

7) alternatively said encapsulated phase change composition containment is made by infiltration of molten phase change material into a shaped porous fiber mass of ceramic fibers inorganically bonded and subsequently solidified, said phase change material having a melting temperature less than 125° F.;

8) optionally, said encapsulated phase change containment of infiltrated porous ceramic fibers having an open hole at the bottom discharging fully molten phase change material into the air gap between said outer and inner shell;

9) a lightweight portable box enclosure with a cover made from wood or plastic inserted and making intimate contact with said encapsulated phase change composition containment and containing valuable documents, photographs and magnetic or electronic media that need to be protected in the event of fire exposure;

10) the temperature within said lightweight portable box reaching a temperature less than 125° F. during a fire exposure of 1550° F. for 30 minutes in accordance with Underwriter Laboratories specification UL72, to thereby preserving valuable documents, photographs and magnetic or electronic media from degradation after a fire event, whereby the lightweight portable fire resistant containment system housing the lightweight portable box sustains exposure to fire having flame temperatures of 1550° F. for up to 30 minutes, during which time the system contents are protected by reducing thermal exposure to a temperature beyond 125° F., so that the degradation temperature of documents, photographs and magnetic or electronic media is not exceeded, and the portable box is especially well suited to be easily removed from the fire resistant containment system and transported without difficulty from place to place to facilitate viewing and display of the documents, photographs and magnetic or electronic media therewithin.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
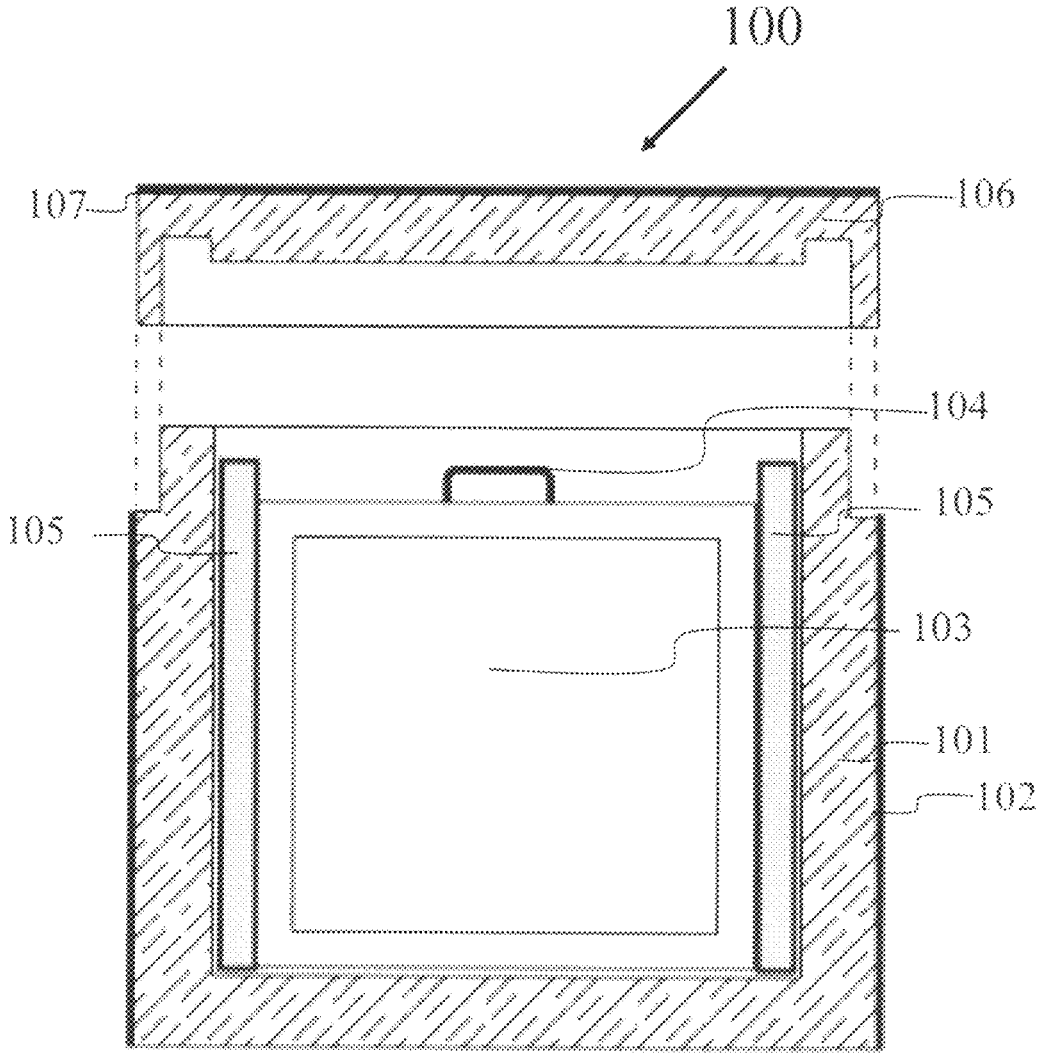
FIG. 1 schematically illustrates the elements of the first embodiment of the lightweight portable fire resistant containment system with a single inorganically bonded ceramic outer shell with an encapsulated phase change containment contacting the inner surface of the outer shell and a lightweight portable box intimately contacting the encapsulated phase change containment.

Storage of important personal papers, memorabilia and valuable items in the home and/or office is oftentimes necessary. Damage or total loss of personal papers and irreplaceable items can occur as the result of fires and floods, which destroy the home or office property. Frequently these important papers are difficult and administratively taxing to replace. Memorabilia, photographs, memory keepsakes and other items are simply irreplaceable and are lost forever. Commercially available safe boxes for the home or office are constructed of heavy materials, making these safes difficult to move and carry. Where lighter weight safes are constructed, these safes fail to provide the ability to withstand high temperatures.

This invention relates to a lightweight portable fire resistant containment system comprising: (i) an outer shell of a storage compartment having an outer surface and inner surface that is composed of refractory ceramic fiber bonded together with an inorganic non smoking refractory binder; (ii) said outer surface of the outer shell protected by a stainless steel or polymeric sheath or high temperature paint preventing entry of hot gases from a fire flame into the porous bonded ceramic fibers of said outer shell (iii) said outer shell optionally having an inner shell having an outer surface and an inner surface made from inorganically bonded ceramic fibers and said outer surface of the inner shell fitting within the inner surface of the outer shell with an air gap there between; (iv) said optional inner shell outer surface having a metallic covering reflecting infrared heat emitted by the inner surface of the outer shell; (v) a lid of inorganically bonded ceramic fibers closing the top of the outer shell to define a contained area; (vi) said inner surface of outer shell or inner surface of optional inner shell having an encased phase change material containment that absorbs heat by latent heat of fusion during melting and prevents temperature rise of the encased phase change material containment beyond the melting point until all of phase change material contained is completely molten; (vii) a lightweight portable box enclosure made from a wooden box or polymeric box with a closure for containing valuable documents, photographs and magnetic or electronic media and documents intimately contacting the inner surface of the encased phase change material containment; viii) optionally, said encased phase change material containment being made from filling porous bonded ceramic fiber mass with molten phase change material having an open bottom hole for discharging molten PCM into the air gap between the outer shell and inner shell, thereby creating a porous insulating body that provides further insulation and prevents further heating of the storage compartment's valuable contents.

The invention of the portable fire resistant containment system with lightweight portable box enclosure is operative to limit heat transfer from the flames to the contents of the lightweight portable box enclosure within the portable fire resistant containment system for a period of at least 30 minutes. Heat transfer from the burning flames to the lightweight portable box enclosure and its contents occurs by three heat transfer mechanisms. First the hot gases can enter the porous ceramic fiber outer shell. These convective heat transfer effects play a major role and must be addressed. This task is accomplished by a gas impervious covering selected from a stainless steel cover or wrap, a polymeric enclosure or a high temperature silicone paint that surrounds the entire outer surface of the outer shell as well as the cover or lid of the portable fire resistant containment system. The outer shell heats by contact with the hot gas stream, and heat is conducted through the walls of the outer shell. Since the walls are formed from inorganically bonded ceramic fibers, they provide a high resistance to conduction due to the insulating properties of the ceramic fibers as well as entrapped air within the porosity of the bonded ceramic that prevents convective heat transfer. When an optional inner shell is provided, there is an air gap provided between the inner surface of the outer shell and the outer surface of the inner shell. Further, the outer surface of the inner shell is covered with infrared reflecting metallic foil, which limits the radiation heat transfer from the inner surface of the outer shell to the outer surface of the inner shell. Any heat received by the outer surface of the inner shell is conducted to the inner surface of the inner shell. An encased phase change material containment contacts the inner surface of the outer shell according to the first embodiment of the invention or the inner surface of the inner shell if provided according to the second and the third embodiments of the invention. The encased phase change material containment absorbs heat by melting or decomposition at a fixed temperature according to the phase change material selected. It is important to have the melting or decomposition temperature of the phase change material slightly lower that is the upper limit of the temperature within the lightweight portable box enclosure. The class 125 heat resistant container according to UL72 requires this upper limit temperature to be 125° F. While many phase change materials are available as detailed in the publication "Review on Thermal Energy Storage with Phase Change Materials and Applications" by Atul Sharma et al., Renewable and Sustainable Energy Reviews, 13, (2009) 318-345. The preferred phase change material is sodium thiosulfate pentahydrate ($Na_2S_2O_3.5H_2O$) which has a melting or decomposition point of 118° F. and a latent heat of fusion of 210 kilojoules per kilogram. It has a density of 1.729 grams per centimeter cube and therefore on a volume base it has a latent heat capacity of 210×1.729 or 363 kilojoules per decimeter cube. If the melting or decomposition temperature is too low, it is quickly exhausted before the 30 minute time period and interior of the portable fire resistant containment system within the area enclosed by the encased phase change material containment increases beyond the desired 125° F. A lightweight portable box enclosure made from wood or plastic is inserted within and makes contact with the encased phase change material containment. The insulating properties of wood or plastic limit the temperature rise within the lightweight portable box enclosure. A temperature sensitive object such as a thumb drive may be saved in a so called 'jump drive or USB flash drive case' which is a nylon bag insulated with polyurethane foam. The temperature within the jump drive or USB flash drive case is even more reduced than what is within the lightweight portable box enclosure. The lightweight portable fire resistant containment system with lightweight portable box enclosure inserted functions as a fireproof compartment for storing documents and other valuable items. The lightweight portable fire resistant containment system has three embodiments that are shown in the figures and discussed in the detailed description below.

In a preferred embodiment, the lightweight portable fire resistant containment system of the present invention comprises a flame resistant safe box fabricated from ceramic fibers that are bonded together by an inorganic flame resistant binder yet leaving adequate porosity to create light weight, low thermal mass insulating boards that form the sides and removable top closure of the lightweight portable fire resistant containment system. Even though the external surface of the box reaches flame temperature when exposed to a burning building, for example, the ceramic fibers and the inorganic binder used resist melting at the flame temperature and the insulating properties of the boards along with its low thermal mass prevent the transfer of heat to the interior of the fire resistant safe box, thereby preventing damage to documents and photographs stored there within the lightweight portable box enclosure. The contents stay below 125° F. temperatures as shown by UL72 specification test results shown in FIG. 4 below.

In FIG. 1 there is shown generally at 100 the first embodiment of the invention of a cross section of the lightweight portable fire resistant containment system for storing documents and other valuable items. In this first embodiment, the lightweight portable fire resistant containment comprises an outer shell 101 composed of bonded refractory ceramic fiber. The no smoke inorganic bonding agent for the fireproof refractory fibers may be sodium silicate, which hardens by reaction with ambient carbon dioxide to form a colloidal silica bond. Other bonding agents include magnesium sulfate hydrate, and other metal-organic compounds that crack when subjected to heat. The bond created by the bonding agent inherently produces a highly porous bond structure due to the requirement of carbon dioxide permeability or charring reaction, and thus results in a highly effective lightweight insulator that has a reasonable mechanical rigidity. The outer surface of the outer shell has a metallic stainless steel wrap, or a polymeric shield or high temperature paint coating such as silicone coating 102 preventing ingress of hot gas from fire or flame directly into the space between the bonded fibers of the outer shell. A lid or cover 106 also made from bonded ceramic fibers is provided to enclose the upper surface of the outer shell forming the containment. As shown in the figure, the lid or cover also has a metallic stainless steel wrap, or a polymeric shield or high temperature paint coating such as silicone coating protection 107 preventing entry of hot gases. The outer shell 101 has an encased phase change material containment 105. The encased phase change material containment may be made from metallic or polymer containment that is filled with powdered phase change material. The preferred phase change material is sodium thiosulfate pentahydrate ($Na_2S_2O_3.5H_2O$). Alternatively, the phase change material may be melted first and infiltrated into a porous inorganically bonded fiber mass and allowed to freeze forming the encased phase change material containment. When sufficient heat is received at the inner surface of the inner shell, it begins to heat the encased phase change material containment raising the phase change material temperature to its melting point. This phase change material can absorb heat until all the phase change material is melted and its heat absorption capacity is exhausted. During this period, the interior temperature of the region of space encircled by the encased phase change material containment within the lightweight portable fire resistant containment system is maintained at or below the melting point temperature of the phase change material. This phase change material melting temperature for the lightweight portable fire resistant containment system is selectable and is generally in the range of 100 to 120° F. The sodium thiosulfate pentahydrate ($Na_2S_2O_3.5H_2O$) phase change material keeps the temperature in the region of space encircled by encased phase change material containment below 118° F. A lightweight portable box enclosure 103 made from wood or polymeric material with a cover is inserted within the region of space and contacting the encased phase change material containment inner surface. Valuable documents, photographs and magnetic or electronic media are placed within the box 103. A jump drive or USB flash drive case 108 may be placed within the box 103 and more temperature sensitive valuable articles may be placed within the case. The light weight portable box enclosure 103 may be withdrawn at any time using handle 104 and transported from place to place to facilitate inspection, display or use of its contents, and put back within the lightweight portable fire resistant containment system to ensure protection of the contents in case of a fire event.

Figure 2:
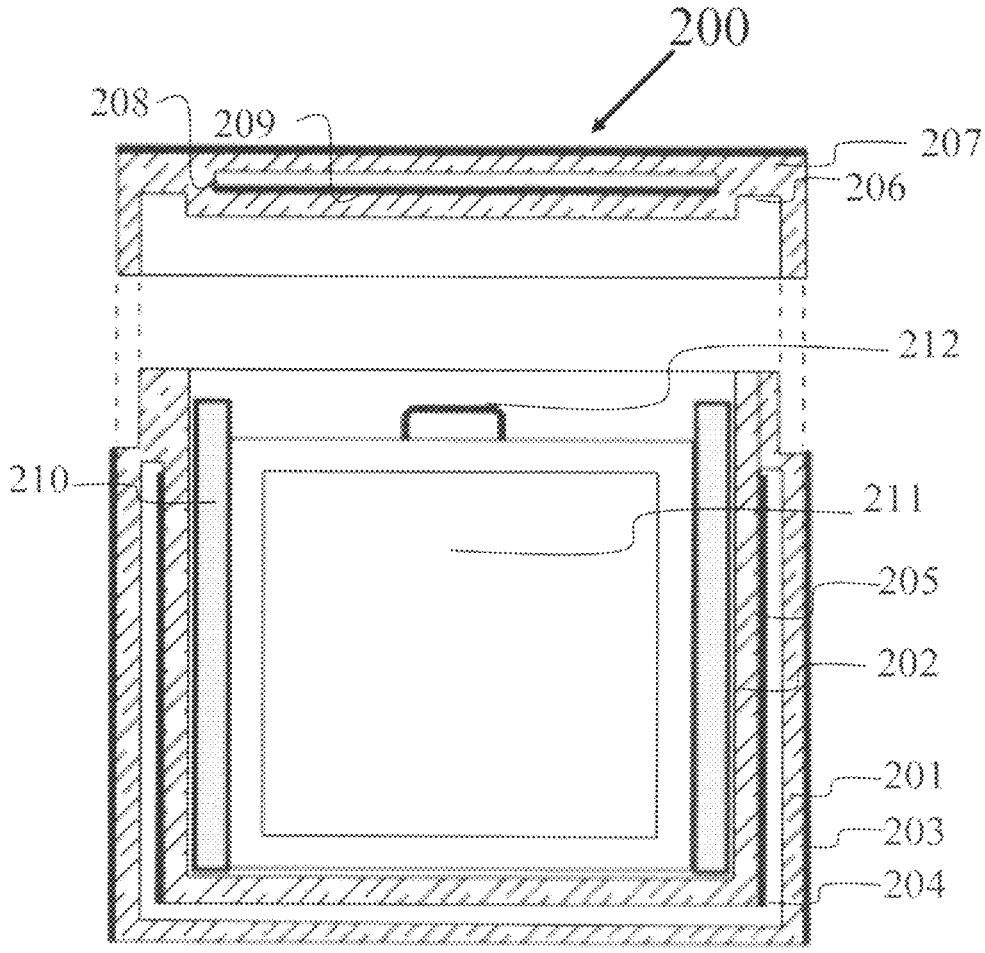
FIG. 2 schematically illustrates the elements of the second embodiment of the lightweight portable fire resistant containment system with an inorganically bonded ceramic outer shell and an inorganically bonded ceramic inner shell with an air gap between outer shell and inner shell and an encapsulated phase change containment contacting the inner surface of the inner shell and a lightweight portable box intimately contacting the encapsulated phase change containment.

In FIG. 2 there is shown generally at 200 the second embodiment of the invention of a cross section of the lightweight portable fire resistant containment system for storing documents and other valuable items. In this second embodiment, the lightweight portable fire resistant containment comprises an outer shell 201 composed of bonded refractory ceramic fiber. The no-smoke inorganic bonding agent for the fireproof refractory fibers may be sodium silicate, which hardens by reaction with ambient carbon dioxide to form a colloidal silica bond. Other bonding agents include magnesium sulfate hydrate, and other metal-organic compounds that crack when subjected to heat. The bond created by the bonding agent inherently produces a highly porous bond structure due to the requirement of carbon dioxide permeability or charring reaction, and thus results in a highly effective lightweight insulator that has a reasonable mechanical rigidity. The outer shell 201 has an inner shell 202 composed of bonded ceramic fibers produced in a manner similar to the outer shell. The outer surface of the outer shell has a metallic stainless steel wrap, or a polymeric shield or high temperature paint coating such as silicone coating 203 preventing ingress of hot gas from fire or flame directly into the space between the bonded fibers of the outer shell. An air gap 204 is present between the inner surface of the outer shell and the outer surface of inner shell. This air gap acts an insulator, reducing the heating rate of the interior of the containment. The outer surface of the inner shell has a metallic reflector 205 that reflects infrared radiation emitted by the interior surface of the outer shell. A lid or cover 206, also made from bonded ceramic fibers, is provided to enclose the upper surface of the outer shell forming the containment. As shown in the figure, the lid or cover also has an air gap 208, a stainless steel metallic protection 207 preventing entry of hot gases and an infrared reflecting metallic foil 209. The inner shell 202 has an encased phase change material containment 210. The encased phase change material containment may be made from metallic or polymer containment that is filled with powdered phase change material. The preferred phase change material is sodium thiosulfate pentahydrate ($Na_2S_2O_3.5H_2O$). Alternatively, the phase change material may be melted first and infiltrated into a porous inorganically bonded fiber mass and allowed to freeze forming the encased phase change material containment. When sufficient heat is received at the inner surface of the inner shell, it begins to heat the encased phase change material containment raising the phase change material temperature to its melting point. This phase change material can absorb heat until all the phase change material is melted and its heat absorption capacity is exhausted. During this period, the interior temperature of the region of space encircled by the encased phase change material containment within the lightweight portable fire resistant containment system is maintained at or below the melting point temperature of the phase change material. This phase change material melting temperature for the lightweight portable fire resistant containment system is selectable and is generally in the range of 100 to 120° F. The sodium thiosulfate pentahydrate ($Na_2S_2O_3.5H_2O$) phase change material keeps the temperature in the region of space encircled by encased phase change material containment below 118° F. A lightweight portable box enclosure 211 made from wood or polymeric material with a cover is inserted within the region of space and contacts the encased phase change material containment inner surface. Valuable documents, photographs and magnetic or electronic media are placed within the box 211. A jump drive or USB flash drive case 213 may be placed within the box 211 and more temperature sensitive valuable articles may be placed within the case. The light weight portable box enclosure 211 may be withdrawn at any time using handle 212 and transported from place to place for inspection, display or use, and thereafter put back within the lightweight portable fire resistant containment system to ensure protection of the box contents in case of a fire event.

Figure 3:
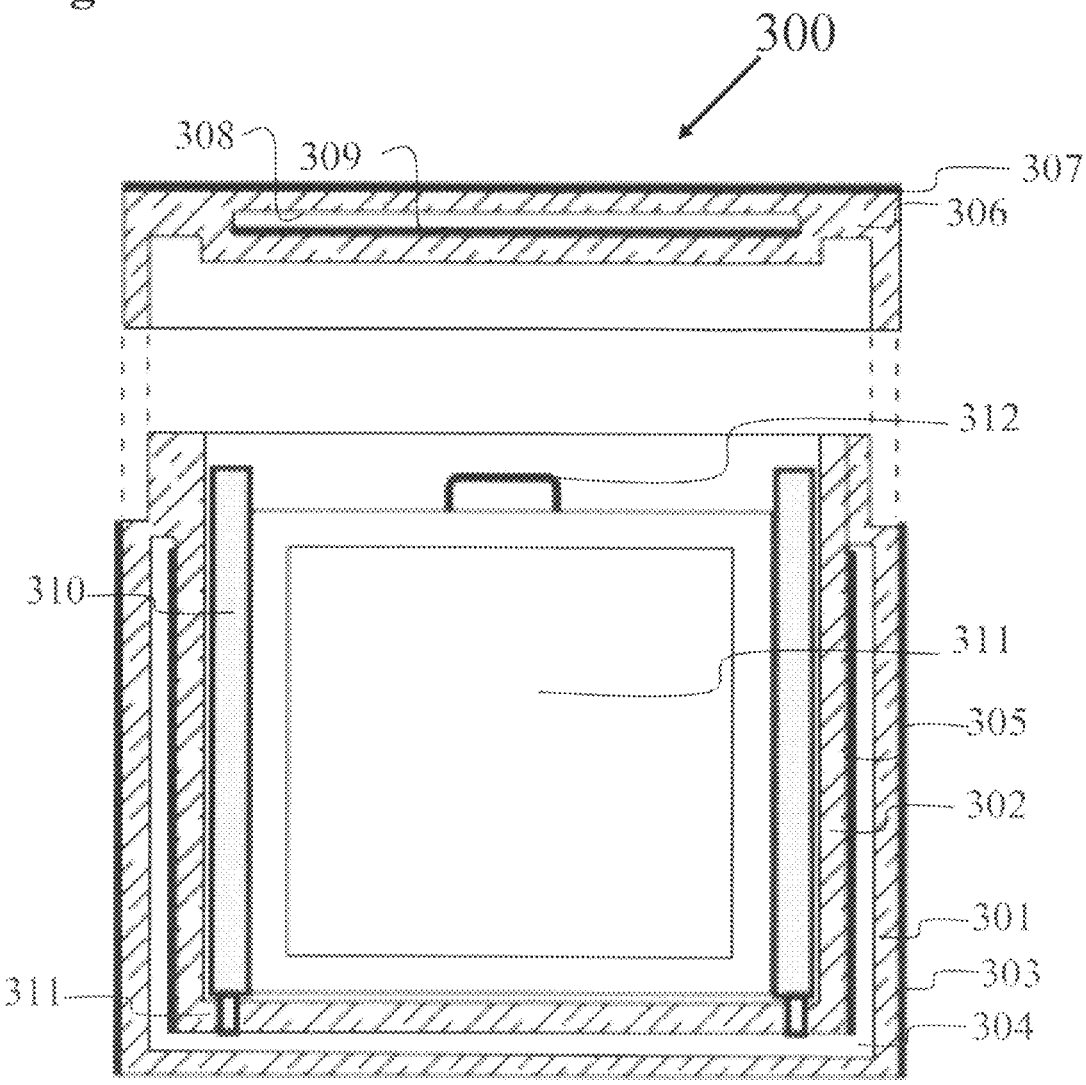
FIG. 3 schematically illustrates the elements of the third embodiment of the lightweight portable fire resistant containment system having an inorganically bonded ceramic outer shell and an inorganically bonded ceramic inner shell with an air gap between outer shell and inner shell and an encapsulated phase change containment material contained in a porous fibrous inorganically bonded fiber mass having a bottom hole for draining molten phase change material into the air gap and the encapsulated phase change containment contacting the inner surface of the inner shell, and a lightweight portable box intimately contacting the encapsulated phase change containment.

In FIG. 3 there is shown generally at 300 the third embodiment of the invention. The Figure depicts a cross section of the lightweight portable fire resistant containment system for storing documents and other valuable items. In this third embodiment, the lightweight portable fire resistant containment comprises an outer shell 301 composed of bonded refractory ceramic fiber. The no-smoke inorganic bonding agent for the fireproof refractory fibers may be sodium silicate, which hardens by reaction with ambient carbon dioxide to form a colloidal silica bond. Other bonding agents include magnesium sulfate hydrate, and other metal-organic compounds that crack when subjected to heat. The bond created by the bonding agent inherently produces a highly porous bond structure due to the requirement of carbon dioxide permeability or charring reaction, and thus results in a highly effective lightweight insulator that has a reasonable mechanical rigidity. The outer shell 301 has an inner shell 302 composed of bonded ceramic fibers produced in a manner similar to the outer shell. The outer surface of the outer shell has a metallic stainless steel wrap, or a polymeric shield or high temperature paint coating such as silicone coating 303 preventing ingress of hot gas from fire or flame directly into the space between the bonded fibers of the outer shell. An air gap 304 is present between the inner surface of the outer shell and the outer surface of inner shell. This air gap acts an insulator that reduces the heating rate of the interior of the containment. The outer surface of the inner shell has a metallic reflector 305 that reflects infrared radiation emitted by the interior surface of the outer shell. A lid or cover 306, also made from bonded ceramic fibers, is provided to enclose the upper surface of the outer shell forming the containment. As shown in the figure, the lid or cover also has an air gap 308, a stainless steel metallic protection 307 preventing entry of hot gases and an infrared reflecting metallic foil 309. The inner shell 302 has an encased phase change material containment 310. The preferred phase change material is sodium thiosulfate pentahydrate ($Na_2S_2O_3.5H_2O$). The encased phase change material containment may be made from metallic or polymer containment that is filled with powdered phase change material. The preferred phase change material is sodium thiosulfate pentahydrate ($Na_2S_2O_3.5H_2O$). Alternatively, the phase change material may be melted first and infiltrated into a porous inorganically bonded fiber mass and allowed to freeze, forming the encased phase change material containment. The encased phase change material containment has a hole at the bottom 311 that communicates with the air gap 304 acting as storage for molten phase change material. This phase change material can absorb heat until all the phase change material is melted and its heat absorption capacity is exhausted. During this period, the interior temperature of the region of space encircled by the encased phase change material containment within the lightweight portable fire resistant containment system is maintained at or below the melting point temperature of the phase change material. This phase change material melting temperature for the lightweight portable fire resistant containment system is selectable and is generally in the range of 100 to 120° F. The sodium thiosulfate pentahydrate ($Na_2S_2O_3.5H_2O$) phase change material keeps the temperature in the region of space encircled by the encased phase change material containment below 118° F. A lightweight portable box enclosure 311 made from wood or polymeric material with a cover is inserted within the region of space and contacting the encased phase change material containment inner surface. Valuable documents, photographs and magnetic or electronic media are placed within the box 311. A jump drive or USB flash drive case 313 may be placed within the box 311 and more temperature sensitive valuable articles may be placed within the case. The light weight portable box enclosure 311 may be withdrawn at any time using handle 312 and transported from place to place for inspection, display or use; and subsequently put back within the lightweight portable fire resistant containment system to assure protection of the box contents in case of a fire event.

Figure 4A:
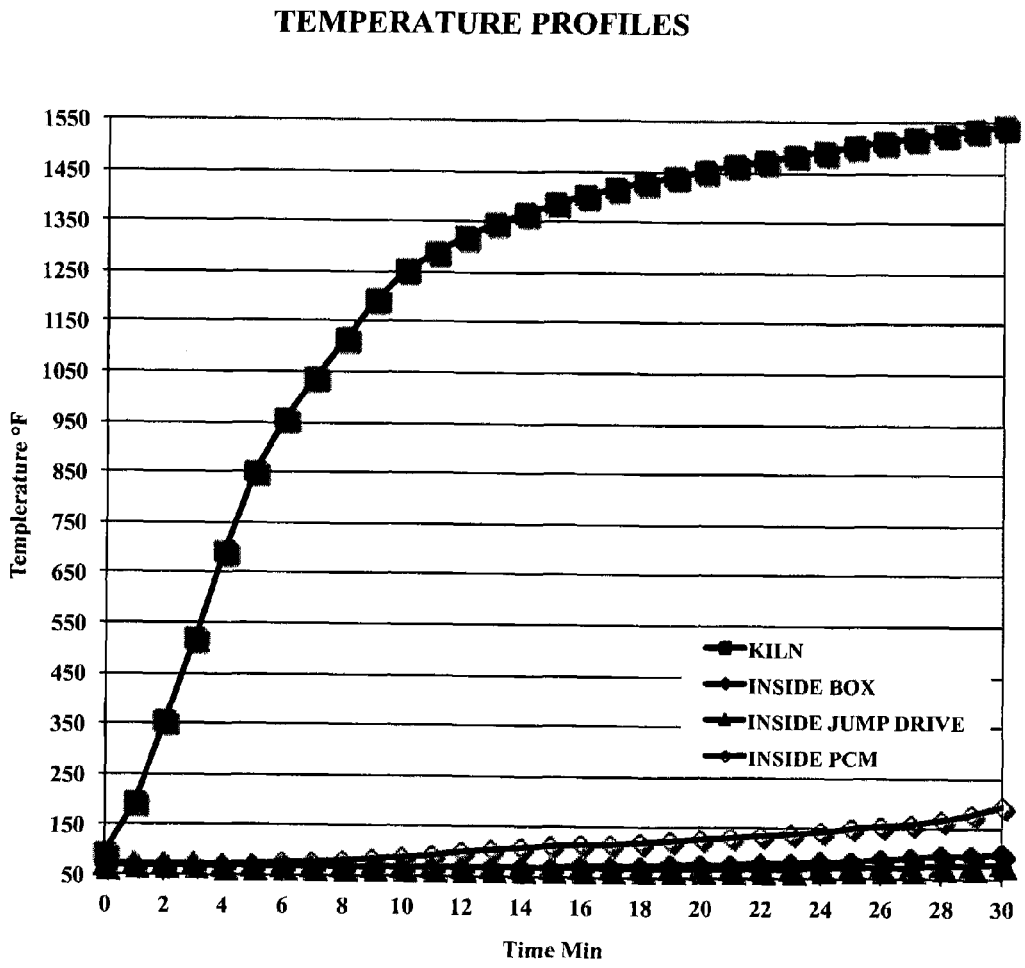
FIG. 4*a* shows kiln temperature as a function of time and temperature within the lightweight portable box of the configuration of FIG. 1 as well as the temperature as a function of time within the encapsulated phase change containment when no lightweight portable box is used in the fire resistant containment system that is placed within a kiln.

In FIG. 4*a* there is illustrated experimental data measured on a lightweight portable fire resistant containment system with and without a lightweight portable box enclosure. The data shows the kiln temperature as a function of time and is in accord with UL72 specification. In the first test, the lightweight portable box enclosure is inserted contacting the encased phase change material containment inner surface and the temperature inside the box is measured. In the same test, a jump drive is placed within the lightweight portable box enclosure and temperature within the jump drive is measured. In a second test the temperature inside the PCM enclosed region is measured. The data is shown below in Table 1. FIG. 4*a* shows the plot of the kiln temperature, temperature inside the lightweight portable box enclosure, temperature inside the jump drive and the temperature in the region enclosed by the encased phase change material containment. Clearly, the temperature in the region enclosed by the encased phase change material containment exceeds 125° F., failing the class 125 UL72 test. However, the temperature inside the and the temperature within the lightweight portable box enclosure and inside the jump drive meet the Class 125 UC72 specification since the temperature measured is only 101.11 and 79.53 respectively. Thus the combination of the encased phase change material containment and the lightweight portable box enclosure creates a fire resistant containment system that meets Class 125 and Class 150 of the Underwriter Laboratories specification UL72. Removal of the lightweight portable box results in a fire resistant containment system that does not pass Class 125 and Class 150 of the Underwriter Laboratories specification UL72.

Figure 4B:
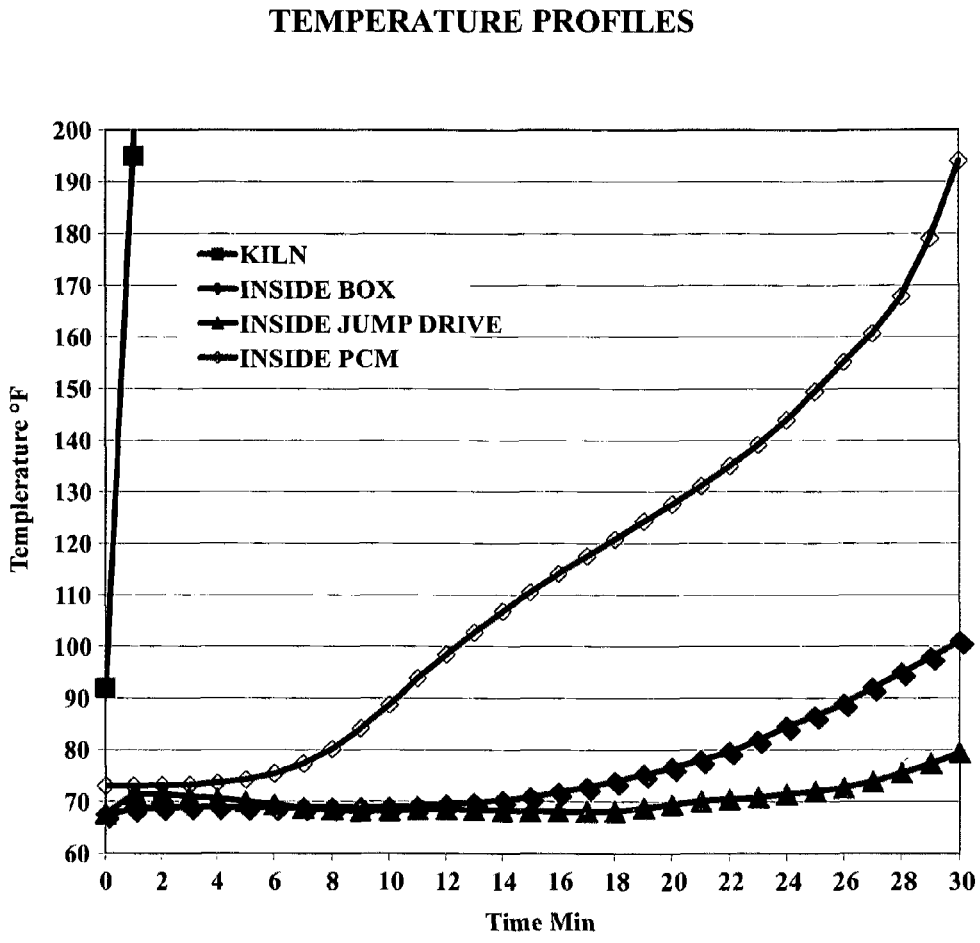
FIG. 4*b* shows at a higher resolution kiln temperature as a function of time and temperature within the lightweight portable box of the configuration of FIG. 1 as well as the temperature as a function of time within the encapsulated phase change containment when no lightweight portable box is used in the fire resistant containment system that is placed within a kiln.

FIG. 4*b* shows the same data of FIG. 4*a* at a better temperature resolution showing the temperature profiles of various arrangements within the fire resistant containment system.

TABLE I

| TIME Min | KILN Temp ° F. | INSIDE BOX Temp ° F. | INSIDE JUMP DRIVE Temp ° F. | INSIDE PCM Temp ° F. |
|---|---|---|---|---|
| 0 | 92 | 67.48 | 67.72 | 73.1 |
| 1 | 195 | 68.61 | 71.42 | 73.1 |
| 2 | 355 | 68.85 | 71.56 | 73.2 |
| 3 | 519 | 68.99 | 71.03 | 73.3 |
| 4 | 690 | 68.99 | 70.63 | 73.7 |
| 5 | 850 | 68.92 | 70.06 | 74.3 |
| 6 | 955 | 68.91 | 69.55 | 75.5 |
| 7 | 1037 | 68.88 | 68.81 | 77.4 |
| 8 | 1118 | 68.9 | 68.52 | 80.2 |
| 9 | 1193 | 68.94 | 68.27 | 84.2 |
| 10 | 1253 | 69.02 | 68.31 | 88.8 |
| 11 | 1290 | 69.18 | 68.58 | 93.9 |
| 12 | 1320 | 69.56 | 68.58 | 98.5 |
| 13 | 1347 | 69.87 | 68.49 | 102.8 |
| 14 | 1368 | 70.29 | 68.36 | 106.9 |
| 15 | 1386 | 70.93 | 68.29 | 110.6 |
| 16 | 1402 | 71.85 | 68.21 | 114.2 |
| 17 | 1416 | 72.85 | 68.16 | 117.6 |
| 18 | 1429 | 74 | 68.24 | 120.9 |
| 19 | 1441 | 75.36 | 68.84 | 124.4 |
| 20 | 1451 | 76.65 | 69.52 | 127.7 |
| 21 | 1463 | 78.06 | 70.19 | 131.2 |
| 22 | 1473 | 79.69 | 70.52 | 135.1 |
| 23 | 1482 | 81.95 | 70.89 | 139.2 |
| 24 | 1493 | 84.52 | 71.53 | 144 |
| 25 | 1502 | 86.59 | 72.03 | 149.5 |
| 26 | 1511 | 88.99 | 72.73 | 155.2 |
| 27 | 1519 | 92.04 | 73.9 | 160.7 |
| 28 | 1527 | 94.94 | 75.6 | 167.9 |
| 29 | 1535 | 97.94 | 77.38 | 179.1 |
| 30 | 1541 | 101.11 | 79.53 | 194.1 |
| 35 | 1375 | | | 218 |
| 40 | 1057 | | | 223.4 |
| 45 | 840 | | | 295.6 |
| 50 | 688 | | | 315.4 |
| 55 | 590 | | | 303.1 |
| 60 | 526 | | | |
| 90 | 260 | | | 256.7 |

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A lightweight portable fire resistant containment system comprising;

a) an outer shell having an outer surface and an inner surface;

b) a lid closing the outer shell, and defining an enclosed space;

c) said outer shell and close fitting lid entirely fabricated from fire resistant ceramic fibers including mineral wool fibers, glass fibers and the like bonded to each other by an inorganic bond, forming a porous insulating yet mechanically strong structure;

d) said inorganic bond being created by sodium silicate exposed to carbon dioxide to create a colloidal silica inorganic bond, hydrated to create a magnesium sulfate hydrate inorganic bond or a metal organic compound heated to create a metal oxide inorganic bond;

e) said outer shell and close fitting lid external surface being covered with a stainless steel or polymeric sheath or painted with a temperature resisting resin to prevent entry of hot gases from the flame into the porosities of a bonded ceramic fiber outer shell;

f) said interior surface of said outer shell having an encapsulated phase change composition containment filled with phase change material powder having a melting or decomposition temperature less than 125° F.;

g) a lightweight portable box enclosure with a cover made from wood or plastic inserted and making intimate contact with said encapsulated phase change composition containment, said portable box containing valuable documents, photographs and magnetic or electronic media appointed for protection in the event of fire exposure;

whereby the lightweight portable fire resistant containment system sustains for up to 30 minutes exposure to fire having flame temperatures of 1550° F., while the contents placed within the lightweight portable box enclosure are protected by reducing thermal exposure to a temperature less than 125° F., and said lightweight portable box can be easily removed from the fire resistant containment system and transported from place to place to facilitate viewing and use.

2. A lightweight portable fire resistant containment system as recited by claim 1, wherein said system meets Class 125 of Underwriter Laboratories specification UC72 maintaining temperature within the lightweight portable box enclosure below 125° F.

3. A lightweight portable fire resistant containment system as recited by claim 1, wherein said system meets Class 150 of Underwriter Laboratories specification UC72, maintaining temperature within lightweight portable box enclosure below 150° F.

4. A lightweight portable fire resistant containment system as recited by claim 1, wherein said encased phase change material containment has a metallic container.

5. A lightweight portable fire resistant containment system as recited by claim 1, wherein said encased phase change material containment has a polymeric container.

6. A lightweight portable fire resistant containment system as recited by claim 1, wherein said encased phase change material containment has a molten phase change material infiltrated into an inorganically bonded shaped fiber mass and solidified.

7. A lightweight portable fire resistant containment system as recited by claim 1, wherein said phase change material is sodium thiosulfate pentahydrate ($Na_2S_2O_3.5H_2O$) with a melting or decomposition temperature of 118° F. with a latent heat of fusion of 210 kilojoules per kilogram.

8. A lightweight portable fire resistant containment system as recited by claim 1, wherein said outer shell has a wall thickness in the range of 12 mm to 25 mm.

9. A lightweight portable fire resistant containment system as recited by claim 1, wherein said encased phase change material containment has a thickness in the range of 15 mm to 25 mm.

10. A lightweight portable fire resistant containment system as recited by claim 1, wherein said lightweight portable box enclosure has therewithin a nylon polyurethane sponge jump drive or USB flash drive case for receiving highly temperature sensitive electronics and magnetic media.

11. A lightweight portable fire resistant containment system as recited by claim 1, wherein said outer shell has an inner shell having an outer surface and inner surface, said outer surface spaced from said inner surface of said outer shell forming an air gap.

12. A lightweight portable fire resistant containment system as recited by claim 11, wherein said inner shell has a wall thickness in the range of 8 mm to 20 mm.

13. A lightweight portable fire resistant containment system as recited by claim 11, wherein said air gap between outer shell and inner shell has a dimension in the range of 3 mm to 6 mm.

14. A lightweight portable fire resistant containment system as recited by claim 11, wherein said outer surface of said inner shell is covered with an infrared reflecting metallic sheet to reduce the amount of heat radiation received from the inner surface of said outer shell, thereby reducing the heating rate of the inner shell.

15. A lightweight portable fire resistant containment system as recited by claim 11, wherein said encased phase change material containment has an aperture in the bottom to discharge molten phase material after exhaustion of latent heat absorption into the air gap between the outer shell and the inner shell.

* * * * *